US009737162B2

(12) United States Patent
Gunderson

(10) Patent No.: US 9,737,162 B2
(45) Date of Patent: Aug. 22, 2017

(54) STOCHASTIC WRAPPED ARTICLE DISPENSER

(71) Applicant: Jeffrey E. Gunderson, Stoughton, WI (US)

(72) Inventor: Jeffrey E. Gunderson, Stoughton, WI (US)

( * ) Notice: Subject to any disclaimer, the term of this patent is extended or adjusted under 35 U.S.C. 154(b) by 77 days.

(21) Appl. No.: 14/798,399

(22) Filed: Jul. 13, 2015

(65) Prior Publication Data

US 2016/0007784 A1 Jan. 14, 2016

Related U.S. Application Data

(60) Provisional application No. 62/024,017, filed on Jul. 14, 2014.

(51) Int. Cl.

| | |
|---|---|
| ***G07F 11/44*** | (2006.01) |
| ***A47G 19/30*** | (2006.01) |
| ***G07F 11/72*** | (2006.01) |

(52) U.S. Cl.

CPC ..... *A47G 21/184* (2013.01); *G07F 11/44* (2013.01); *G07F 11/72* (2013.01)

(58) Field of Classification Search

CPC ..... B65D 83/02

See application file for complete search history.

(56) References Cited

U.S. PATENT DOCUMENTS

| | | | | |
|---|---|---|---|---|
| 1,588,386 A | | 6/1926 | Young | |
| 1,637,767 A | | 8/1927 | Delano | |
| 1,907,628 A | | 5/1933 | Walsh | |
| 2,251,489 A | | 8/1941 | Koziel | |
| 2,551,424 A | | 5/1951 | Donald | |
| 2,843,292 A | | 7/1958 | Baehr | |
| 3,095,118 A | * | 6/1963 | Wills | A47G 21/184 221/152 |

* cited by examiner

*Primary Examiner* — Timothy Waggoner
*Assistant Examiner* — Ayodeji Ojofeitimi
(74) *Attorney, Agent, or Firm* — Stiennon & Stiennon

(57) ABSTRACT

A dispenser for wrapped straws has a housing with a hopper with upright plates forming parts of reciprocating assemblies that move outwardly when a front actuator engages a cam plate for axial movement. A composite plunger assembly travels on the cam plate. The plunger assembly has multiple spring loaded ejector members. When the cam plate is advanced one of the ejector members will encounter a straw in the hopper which is by chance positioned to be advanced through an outlet opening. The other ejector members, encountering straws not well positioned for ejection, will be depressed, but will not dispense a straw. A user extracts the one partially protruding straw and returns the cam plate to its initial position which causes the reciprocating assemblies to return to a central position, thereby shuffling the wrapped straws and presenting them again to the plunger assembly for the next dispensing.

11 Claims, 6 Drawing Sheets

STOCHASTIC WRAPPED ARTICLE DISPENSER

CROSS REFERENCES TO RELATED APPLICATIONS

This application claims the benefit of priority of U.S. provisional App. No. 62/024,017, filed Jul. 14, 2014, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to article dispensers in general, and more particularly to dispensers of wrapped articles such as drinking straws.

Many dispensers exist for plastic drinking straws. As uniform cylindrical objects they are readily accessed, indexed, and dispensed from a bin or hopper. Yet often customers prefer to receive their straws in an enclosed package, to keep the straw clean as it is transported. These packages are typically comprised of a paper or plastic wrapping. The wrapped straw, then, is not so uniform an object as the straw itself, and presents significant challenges in its dispensing, since it is asymmetrical and a compound assembly of elements. What is needed is a convenient and economical dispenser which can readily and repeatably dispense articles wrapped in paper, plastic, or the like.

SUMMARY OF THE INVENTION

The wrapped article dispenser of this invention has a housing with a hopper with upright plates forming parts of reciprocating assemblies that move outwardly with each straw which is dispensed. The hopper receives a quantity of the wrapped articles, such as straws. A composite plunger assembly travels on a cam plate when a front actuator arrangement is engaged, such as by depressing a front slider. The plunger assembly has multiple spring loaded ejector members. When the cam plate is advanced, one of the ejector members will likely encounter a straw in the hopper which is by chance positioned to be advanced through an outlet opening in the housing. The other ejector members, encountering straws not well positioned for ejection, will be depressed, but will not dispense a straw. The one straw which is ejected protrudes from the housing, and is engaged by a user and removed. Once a wrapped straw has been removed, the front knob is released, which causes the reciprocating assemblies to return to a central position, thereby shuffling the wrapped straws and presenting them again to the plunger assembly for the next dispensing.

It is an object of the present invention to provide a dispenser which dispenses wrapped articles in packages which are not identical in orientation and configuration.

It is another object of the present invention to provide a dispenser of elongate articles which are not entirely uniform.

It is a further object of the present invention to provide a compact dispenser for wrapped straws which may be mounted in a counter.

Further objects, features and advantages of the invention will be apparent from the following detailed description when taken in conjunction with the accompanying drawings.

Further objects, features and advantages of the invention will be apparent from the following detailed description when taken in conjunction with the accompanying drawings.

DESCRIPTION OF THE PREFERRED EMBODIMENTS

Figure 1:
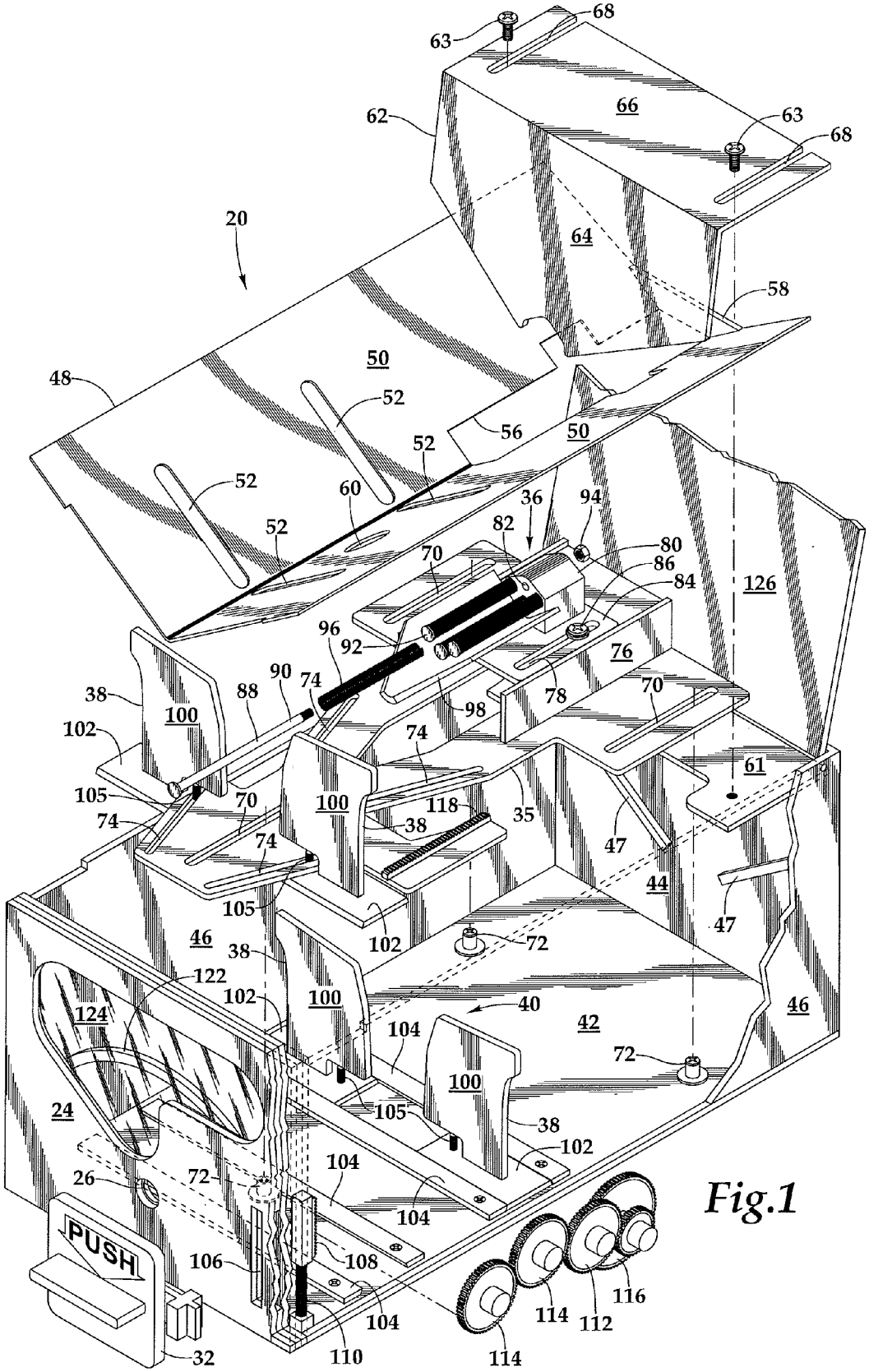
FIG. 1 is an exploded isometric view, partially broken away in section, of the wrapped article dispenser of this invention.

Referring more particularly to FIGS. 1-7, wherein like numbers refer to similar parts, a dispenser 20 for wrapped articles such as straws is shown. As shown in FIG. 1, the dispenser 20 has a housing 22 with a front wall 24 which has a circular dispensing outlet 26 through which single wrapped straws 28 are dispensed from a hopper 30. A user causes a wrapped straw 28 to be dispensed by depressing an actuator handle 32 which forms a part of an actuator assembly 34 which drives a cam plate 35 to simultaneously move a plunger assembly 36 into the hopper 30 to advance a straw and to move the agitator plates 38 which form a part of an agitator assembly 40 to agitate the collection of wrapped straws present in the hopper, with the result that an end of a single wrapped straw 28 is projected through the dispensing outlet 26 for engagement and removal by a user. As shown in FIG. 1, a lid 126 may be provided to close the top of the housing.

Figure 6:
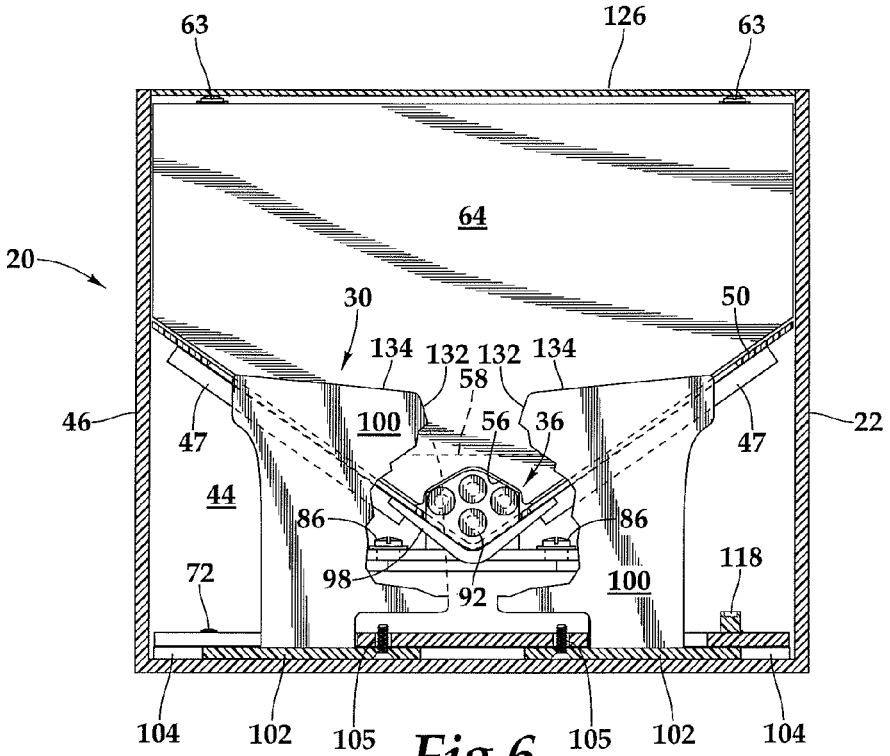
FIG. 6 is a cross-sectional view of the dispenser of FIG. 4 taken along section line 6-6, portions of the agitator plates being shown partially broken away.
Figure 7:
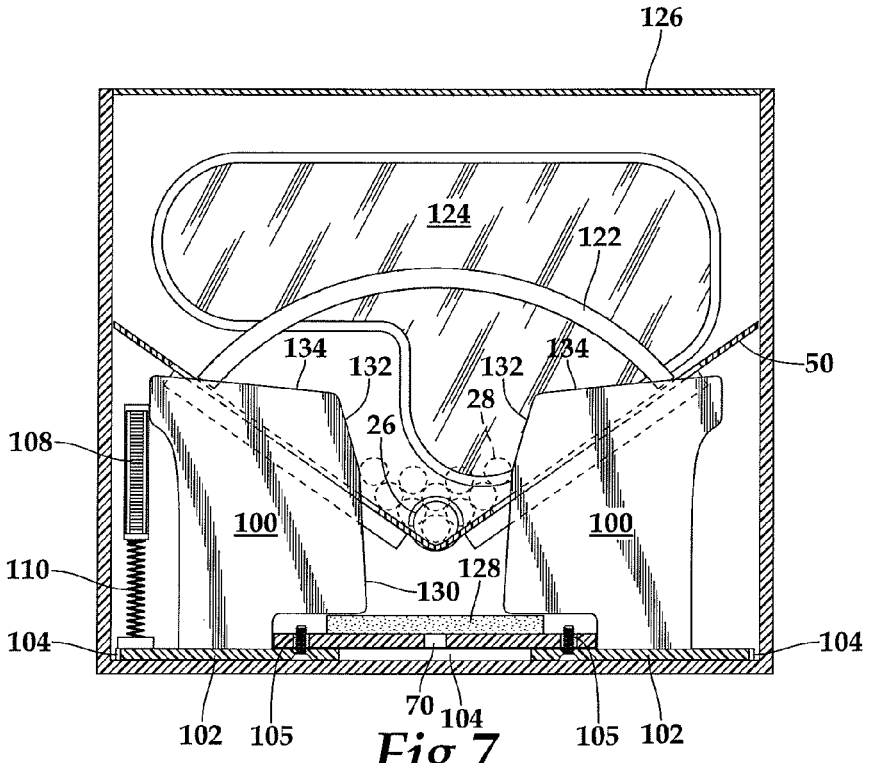
FIG. 7 is a cross-sectional view of the dispenser of FIG. 5 taken along section line 7-7.

The housing 22 is a rectangular box having a bottom wall 42 from which the front wall 24 extends upwardly. A rear wall 44 also extends from the bottom wall 42 and is spaced parallel to the front wall 24. Side walls 46 join the front wall 24 and the rear wall 44. Angled support steps 47 are mounted to the rear wall 44, as shown in FIG. 6, and to the front wall 24, as shown in FIG. 7 to receive a trough element 48, best shown in FIG. 1.

The trough element 48 has two hopper plates 50 which are angled with respect to each other, for example at about 110 degrees to produce a concave upwardly opening volume for the receipt of a stock of wrapped straws 28. Each hopper plate 50 of the trough element 48 has two clearance slots 52 which extend parallel to the front wall 24 and through which agitator plates 38 extend. A plunger clearance hole 56 is formed in the rear of the trough element 48 between the two hopper plates 50. For rigidity of the trough element 48, a rear brace 58 may be positioned to connect the two hopper plates 50 above the plunger clearance hole 56 as shown in FIG. 6. A circular finger hole 60, about one inch in diameter is positioned in one of the hopper plates 50 to permit the trough element's insertion within and removal from the housing 22.

The housing 22 has an end plate shelf 61 adjacent the housing rear wall 44 which is parallel to the housing bottom wall. Two screws 63 are engaged with the shelf 61. An end bracket 62 has an end plate 64 which is inclined at about 98 degrees with respect to a top wall 66 which extends along the shelf 61. The end bracket end wall 64 has a tapered shape which allows it to extend into the trough element 48 to form a rearward barrier for the contents of the hopper 30 which is defined between the housing front wall 24, the end bracket end wall 64 and the two hopper plates 50. The end bracket top wall 66 has two parallel slots 68 through which the shelf screws 63 extend. The end bracket may thus be adjusted within the housing to position the end plate 64 at an appropriate distance from the housing front wall 24 to adequately contain wrapped straws 28 of various lengths. The screws 63 are tightened when the desired position of the end plate 64 is reached.

The distance between the housing front wall 24 and the end bracket end plate 64 is somewhat greater than the total length of the wrapped straws 28. For example a 7 and ¾ inch straw within an 8 and ¼ inch plastic wrapping may be retained within a hopper of about 9 inches length. Straws may be about ¼ inch in diameter. The dispenser may be constructed to accommodate straw diameters from about 0.125 to 0.5 inches. The diameter of the dispensing opening may be up to about 1.5 times the diameter of the straws to be dispensed.

Figure 2:
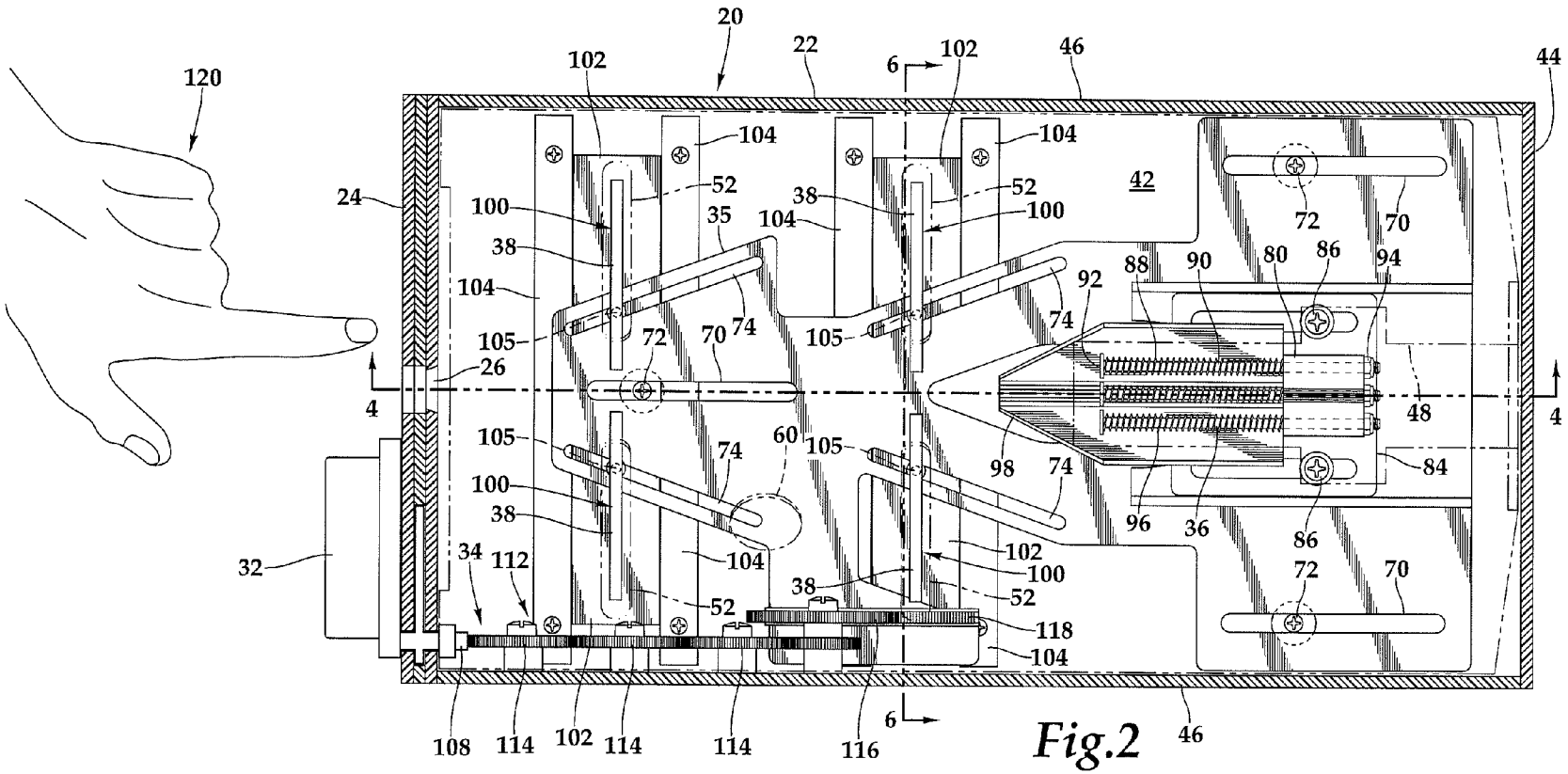
FIG. 2 is a top plan view of the dispenser of FIG. 1, broken away in section with the trough element in phantom lines, the device shown before actuation.
Figure 3:
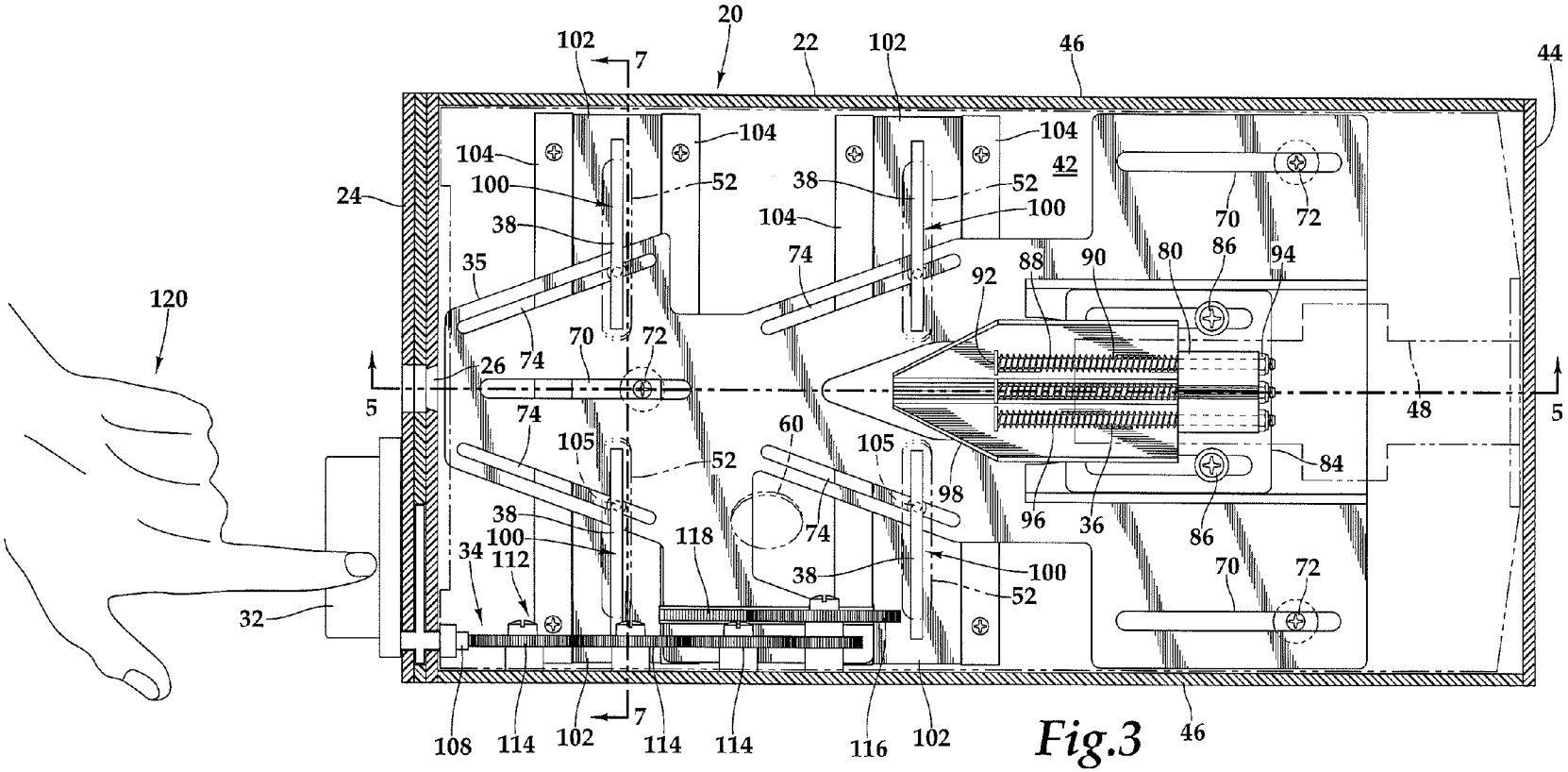
FIG. 3 is a top plan view of the dispenser of FIG. 2, broken away in section with the trough element in phantom lines, in a dispensing configuration, the actuation handle being not broken away in section.

As shown in FIGS. 2 and 3, a flat cam plate 35 extends along the length of the housing 22 beneath the trough element 48 and parallel to the housing bottom wall 42. The cam plate 35 is engaged by the actuator assembly 34 for reciprocating motion between an at-rest position, shown in FIG. 2, and an actuated position shown in FIG. 3. The cam plate 35 has three parallel alignment slots 70 which extend parallel to the housing side walls 46 and which receive vertical studs 72 which project upwardly from the housing bottom wall to constrain the cam plate 35 to move along a strictly rectilinear path. The cam plate has two sets of converging slots 74 which are positioned on the forward end of the cam plate 35 and which control the motion of the agitator assembly 40 as described below.

A platform 76 projects upwardly from the cam plate 35 and has two slots 78 which allow the plunger assembly 36 to be secured in a desired position with respect to the cam plate. As shown in FIG. 1, the plunger assembly 36 has a body 80 which is a plastic block with four axially extending through openings 82 arranged in a diamond pattern as shown in FIG. 6. The body 80 is fixed to a mounting plate 84 which is engaged with fasteners 86 which extend within the slots 78 of the platform 76.

As shown in FIG. 2, four ejector members 88 generally in the shape of nails, have an axial shaft 90 and a forward head 92. The heads 92 should be at least as great in diameter as the diameter of the straw so that the heads do not puncture the straw wrapper and extend within the straws. The axial ejector member shafts 90 extend through the parallel openings 82 in the body 80 and therefore can travel axially in the openings. The shafts 90 may be threaded where they project from the rear of the body 80 and retained with nuts 94. A spring 96 is positioned between each ejector member head 92 and the body 80. The springs 96 bias the ejector members 88 towards the dispensing outlet 26 of the housing 22.

Figure 5:
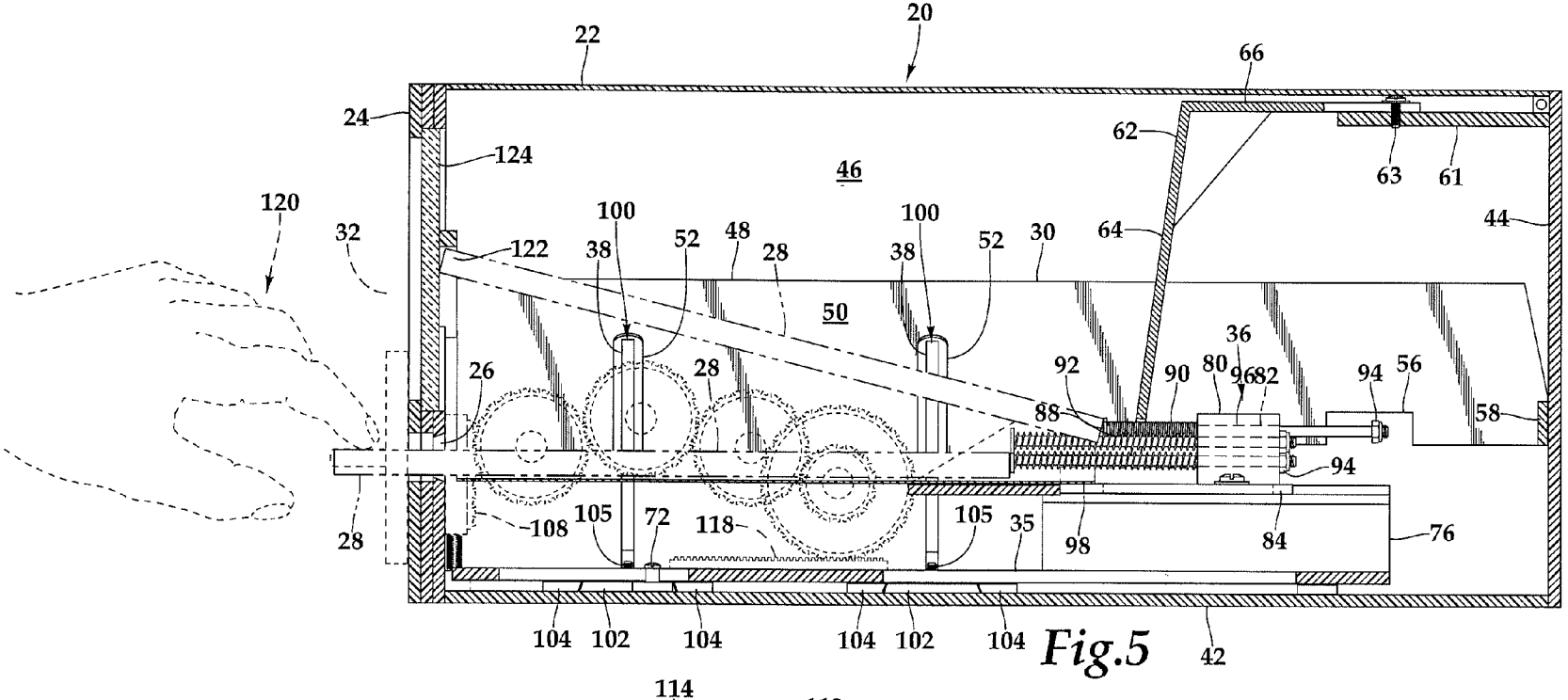
FIG. 5 is a cross-sectional view of the dispenser of FIG. 3 taken along section line 5-5, the device being shown in an actuated configuration.
Figure 5A:
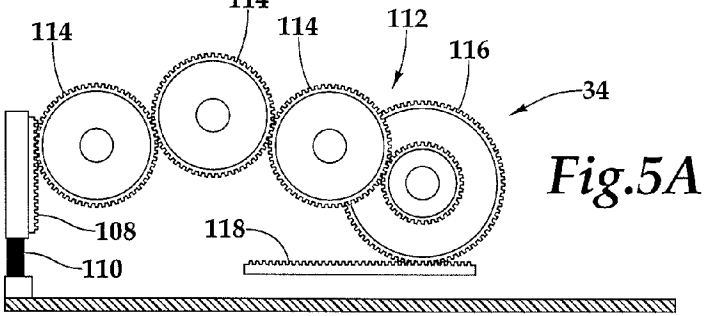
FIG. 5A is an isolated view of portions of the actuation assembly of FIG. 5.

As shown in FIGS. 2 and 6 a concave guard 98 extends beneath the ejector members 88. The guard 98 extends beneath the trough element 48, restraining the escape of material from the hopper through the plunger clearance hole 56. The four ejector members 88, the spring 96, and the body 80 comprise the plunger assembly 36 which applies an ejecting force to the wrapped straws 28, by which one straw is urged to exit the housing, while the other straws which encounter the ejector member 88, but which do not have clear exit path from the housing, depress the other ejector members 88 of the plungers assembly as shown in FIG. 5 (in which only a single dispensed wrapped straw and a single non-dispensed straw is shown).

Unlike unwrapped straws, which are uniform cylindrical bodies which perform in a predictable way, wrapped straws are composite asymmetrical elements which have behavior which is less repeatable when subjected to a force. The dispenser 20 is arranged to operate without certainty as to which wrapped straw is to be ejected next and to condition the load of straws to position a straw for dispensing. Hence the hopper 30 is not a static arrangement, but one which subjects the straws in the hopper to shuffling forces with each straw dispensed. These forces are applied to the straws by the agitator assembly 40 which is comprised of reciprocating agitator elements 100, shown in FIGS. 6 and 7.

Figure 4:
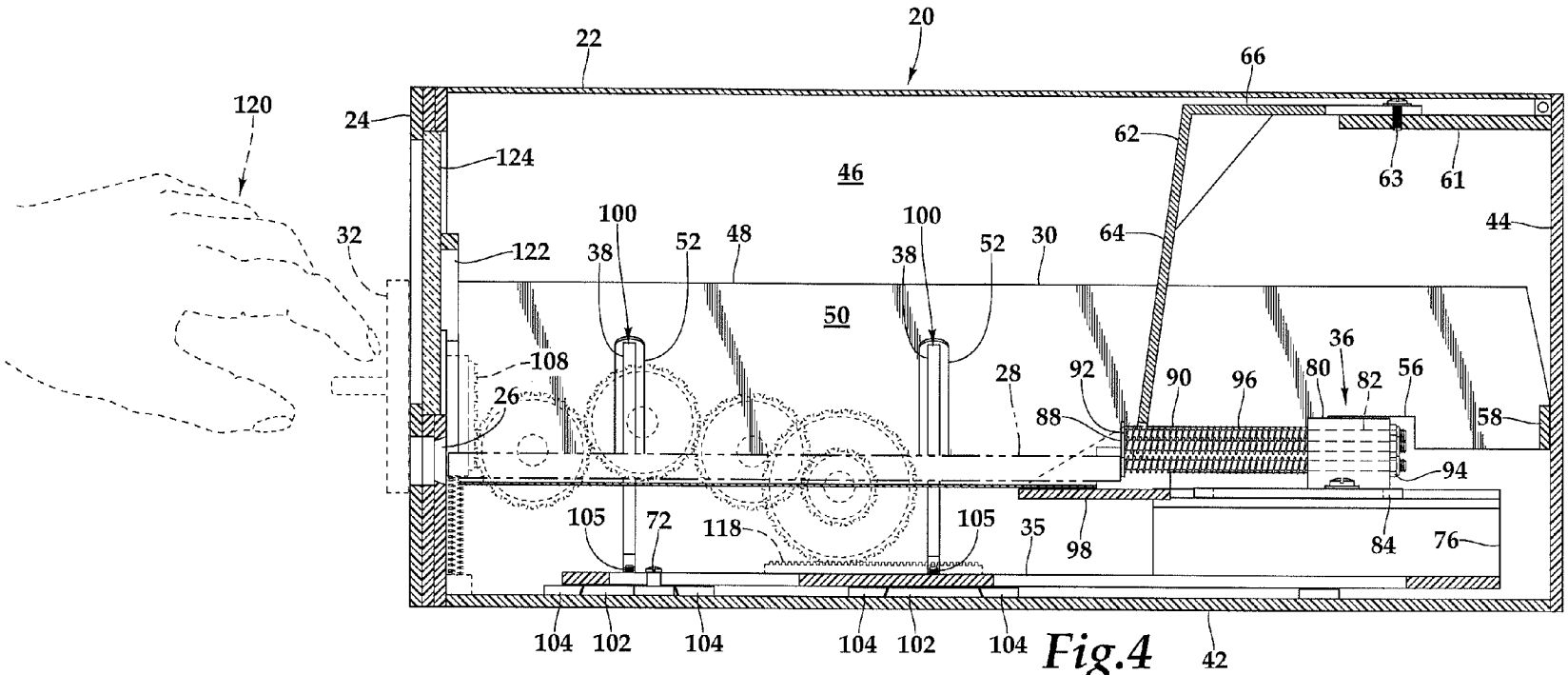
FIG. 4 is a cross-sectional view of the dispenser of FIG. 2 taken along section line 4-4, with the actuation assembly being shown in broken lines, the device being shown before actuation.
Figure 4A:
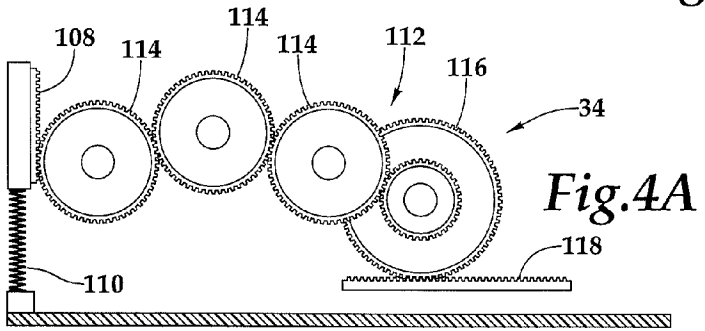
FIG. 4A is an isolated view of portions of the actuation assembly of FIG. 4.

As shown in FIG. 6, each agitator element 100 has a plastic agitator plate 38. The plate 38 may be about ⅛ inch thick, and about 3¼ inches tall. Each plate 38 is mounted to a sliding beveled base plate 102 which is mounted perpendicular to the agitator plate and which is retained by two keyed rails 104 mounted to the bottom wall 42 of the housing 22 for transverse motion with respect to the center of the cam plate 35. Each sliding base plate 102 has beveled edges which engage with corresponding beveled edges of the rails 104, as shown in FIGS. 4 and 5. A cam follower element 105, such as an inverted screw, projects up from each base plate 102 beneath the agitator plate 38. The cam follower element 105 extends into one of the converging slots 74 of the cam plate 35 such that motion of the cam plate will cause the agitator elements 100 to move transversely guided by the rails 104.

The actuator handle 32 is mounted for vertical travel within a slot 106 on the front wall 24 of the housing 22. A vertical rack 108 extends into the interior of the housing, where a spring 110 biases the handle 32 in an up position. The rack 108 engages a gear train 112, shown in FIGS. 1. 4A and 5A, which is comprised of multiple gears 114, including a final gear 116 which engages a horizontal rack 118 which is mounted to the cam plate 35 and extending in an axial direction which extends between the front wall and the rear wall of the housing. The handle 32, the vertical rack 108, the gear train 112, and the horizontal rack 118 comprise the actuator assembly 34. Depression of the actuator handle 32 causes the vertical rack 108 to rotate the gears of the gear train 112 which, by acting on the horizontal rack 118, causes the cam plate to advance axially towards the front wall of the housing.

The dispenser 20 may be placed on a counter, or it may be mounted within a drawer beneath a counter so that the front wall and the handle 32 are accessible to a user 120. When a user 120 desires to dispense a wrapped straw 28 from the dispenser 20, the handle 32 is engaged and depressed, as shown in FIGS. 3 and 5. The depression of the handle 32 causes the actuator assembly 34 to operate to advance the cam plate 35 towards the front wall 24, and to thereby bring the composite plunger assembly 36 forward so that the four ejector members 88 pass through an opening 56 in the end wall 64 of the end bracket 62, bringing the plunger assembly 36 into the hopper 30 where the heads of 92 the ejector members may engage against wrapped straws within the hopper. The four ejector members 88 extend as much as an inch and a quarter from the body 80. A resilient cushion 128, shown in FIG. 7, may be mounted to the housing front wall 24 to absorb the shock of the cam plate reaching the frontmost position of its travel.

It is likely that more than one of the multiple ejector members 88 will encounter a wrapped straw within the filled hopper 30. Yet some of the wrapped straws will respond to the pressure of the ejector member which engages it by traveling off axis, and will abut against the front wall 24 of the housing where it is impossible for the wrapped straw to be dispensed. In such a case the ejector member 88 is depressed against the force of a spring 96. The engaged straw may bend, but should not be permanently deformed. To restrict the ends of the wrapped straws from traveling too far off axis, the front wall 24 may be provided with a semicircular upper barrier 122, shown in FIG. 7, which engages wrapped straw ends traveling upwardly. The upper barrier 122 may be made of transparent plastic and may cross a transparent observation panel 124 which is a part of the front wall 24. Some of the ejector members 88 may not encounter a wrapped straw at all, and one of the ejector members is likely to engage a wrapped straw which is in position to be pressed in the direction of the hopper front wall, but in a direction which will cause the straw to pass through the dispensing outlet 26. As shown in FIGS. 3 and 5, this wrapped straw will be urged through the dispensing outlet 26 so a portion, perhaps ¼ to ½ inch length of straw will protrude. The protruding segment of wrapped straw 28 can then be engaged between the fingers of the user 120 and removed from the dispenser 20.

It should be noted that it is a matter of probabilities whether a wrapped straw within the hopper will be properly positioned to be ejected. One possibility is that actuation of the handle 32 will not successfully dispense a wrapped straw. However this is an acceptable outcome, because of the shuffling effects of the apparatus, to be discussed below, the apparatus can be engaged by the user again, with a good chance that the straw will be dispensed on a subsequent try.

The same motion of the user 120 which causes the plunger assembly 36 to urge a wrapped straw towards the dispensing outlet 26 simultaneously activates the agitator assembly 40 to agitate and adjust the position of all the wrapped straws 28 within the hopper 30. As shown in FIG. 2, when the cam plate 35 is moved forward by the actuator assembly 34, the cam follower members 105 of each agitator element 100, engaged within the converging slots 74 of the cam plate will be moved transversely to the direction of travel of the cam plate, driving the agitator plates 38 apart and causing them to withdraw within the slots 52 of the trough element 48. This movement generally causes the stack of straws to collapse downwardly as the agitator plates move outwardly as shown in FIG. 7. When the user releases the handle 32, the spring 110 urges the handle and its attached vertical rack upwardly, which, acting through the gear train, causes the cam plate 35 to return to its rearmost position. This also reshuffles or agitates the arrangement of wrapped straws, causing many to move upwardly and inwardly. This random rearrangement of the wrapped straws opens up the possibility that the next time the dispenser 20 is operated, a wrapped straw will be properly positioned for dispensing.

As best shown in FIGS. 6 and 7, in the unactuated state the region between the four agitator plates 38 is narrow, preferably less than the width of three abreast wrapped straws 28. As shown in FIG. 7, the inwardly facing perimeter of each agitator plate may be configured to define multiple volumes within the hopper 30. A first segment 130 is steeply inclined, about 3 degrees from the vertical. A second segment 132 is inclined about 18 degrees from the vertical, and a third segment 134 is nearly horizontal, being inclined about 4 degrees above a horizontal plane. Thus it will be observed that when the agitator plates are returned to the unactuated condition, the volume between the plates decreases and the wrapped straws 28 are urged up the inclined segments of the agitator plates, where the majority of the wrapped straws in a full hopper will reside above the segments 134.

It should be noted that the cam plate 35 may be activated for axial motion by other mechanisms than the rack and gear train arrangement illustrated. For example, the dispenser 20 may be provided with a pull knob which serves to directly advance the cam plate, or a linkage arrangement may be used.

The dispenser 20 is readily adjustable with a single screwdriver to accommodate wrapped straws of different dimensions. The mounting plate 84 may be positioned axially along the platform 74, and the end bracket 62 may be adjusted axially to define the rear extent of the hopper 30.

It should be noted that a dispenser of the invention may be configured for dispensing a variety of wrapped articles, for example stir sticks, or elongate utensils.

It is understood that the invention is not limited to the particular construction and arrangement of parts herein illustrated and described, but embraces all such modified forms thereof as come within the scope of the following claims.

I claim:

1. A dispenser for wrapped articles, comprising:

a housing having a hopper which receives a plurality of wrapped articles therein, the housing having a dispensing outlet through which a wrapped article may escape from the housing;

a cam plate extending in an axial direction within the housing beneath the hopper;

a plurality of ejector members mounted to the cam plate and biased to project axially towards the dispensing outlet, wherein axial advancement of the cam plate advances the ejector members into the hopper for ejection of a wrapped article through the dispensing outlet; and wherein a body projects from the cam plate, and wherein the body has a plurality of parallel openings, and wherein the ejector members extend through the parallel openings in the body, and wherein a spring is engaged between the body and each of the ejector members to bias the ejector members towards the dispensing outlet.

2. The dispenser of claim 1 further comprising:

a plurality of agitator plates mounted to the housing to extend into the hopper and engage wrapped articles contained therein, wherein a transverse direction is defined perpendicular to the axial direction;

an actuator assembly mounted to the housing and arranged to cooperate with the cam plate to move the cam plate in the axial direction;

wherein the cam plate cooperates with the plurality of agitator plates to move them in the transverse direction when the cam plate is moved in the axial direction.

3. The dispenser of claim 2 wherein the hopper has portions defining slots to receive each of the agitator plates, and wherein portions of each agitator plate extend through one of the slots.

4. The dispenser of claim 3 wherein the cam plate has portions defining a pair of slots which converge as they extend in the axial direction, and wherein one of the agitator plates is engaged within each of the slots of the pair of slots and said engaged agitator plates have cam follower portions extending within the slots such that motion of the cam plate towards the dispensing outlet causes the agitator plates engaged with the slots of the pair of slots to move apart from each other in the transverse direction.

5. The dispenser of claim 1 wherein the hopper is comprised of two hopper plates which extend upwardly and outwardly from each other, and further comprising a concave guard positioned between the cam and the plurality of ejector members, the guard being positioned beneath the two hopper plates.

6. A dispenser for articles, comprising:

a housing having a front wall having portions defining a dispensing outlet, and a rear wall spaced in an axial direction from the front wall;

an upwardly opening trough positioned within the housing between the front wall and the rear wall, the trough positioned to receive a plurality of articles therein;

wherein the trough has portions defining slots to receive each of the agitator plates, wherein the trough slots extend in the transverse direction and wherein portions of each agitator plate extend through one of the trough slots;

a cam plate extending axially within the housing beneath the trough;

a plurality of ejector members mounted to the cam plate and biased to project axially towards the dispensing outlet;

a plurality of upwardly extending agitator plates mounted to the housing for motion in the transverse direction; and an actuator assembly mounted to the housing and connected to the cam plate such that activation of the actuator assembly moves the cam plate in the axial direction, wherein the cam plate cooperates with the agitator plates such that axial motion of the cam plate results in motion of the agitator plates in a transverse direction perpendicular to the axial direction, and wherein axial advancement of the cam plate advances the ejector members into the trough for engagement of an article within the trough and dispensing at least a portion of said article through the dispensing outlet.

7. The dispenser of claim 6 wherein the cam plate has portions defining a pair of cam plate slots which converge as they extend in the axial direction, and wherein one of the agitator plates is engaged within each of the slots of the pair of cam plate slots and said engaged agitator plates have cam follower portions extending within the cam plate slots such that motion of the cam plate towards the dispensing outlet causes the agitator plates engaged with the slots of the pair of cam plate slots to move apart from each other in the transverse direction.

8. The dispenser of claim 6 wherein a body projects from the cam plate, and wherein the body has a plurality of parallel openings, and wherein the ejector members extend through the parallel openings in the body, and wherein a spring is engaged between the body and each of the ejector members to bias the ejector members towards the dispensing outlet.

9. A dispenser for articles, comprising;

a housing having a front wall having portions defining a dispensing outlet, and a rear wall spaced in an axial direction from the front wall;

an upwardly opening trough positioned within the housing for receiving a plurality of articles;

a first agitator member mounted to the housing for movement in a transverse direction perpendicular to the axial direction;

a second agitator member mounted to the housing for movement in the transverse direction;

a plunger assembly having a plurality of parallel ejector members extending in the axial direction and biased towards the dispensing outlet;

an actuator mounted to the housing and linked to the plunger assembly, the first agitator member and the second agitator member such that activation of the actuator causes portions of the ejector members to extend into the trough to urge portions of one of the articles within the trough through the dispensing outlet while also moving the agitator members in the transverse direction to bring about motion of articles in the transverse direction;

wherein the actuator is linked to the plunger assembly by a cam plate which extends within the housing beneath the trough; and wherein a body projects from the cam plate, and wherein the body has a plurality of parallel openings, and wherein the ejector members extend through the parallel openings in the body, and wherein a spring is engaged between the body and each of the ejector members to bias the ejector members towards the dispensing outlet.

10. The dispenser of claim 9 wherein the trough has portions defining slots to receive each of the agitator members, wherein the trough slots extend in the transverse direction and wherein portions of each agitator plate extend through one of the trough slots.

11. The dispenser of claim 10 wherein the cam plate has portions defining a pair of cam plate slots which converge as they extend in the axial direction, and wherein one of the agitator plates is engaged within each of the slots of the pair of cam plate slots and said engaged agitator plates have cam follower portions extending within the cam plate slots such that motion of the cam plate towards the dispensing outlet causes the agitator plates engaged with the slots of the pair of cam plate slots to move apart from each other in the transverse direction.

* * * * *